United States Patent [19]

Fohl et al.

[11] 3,931,536

[45] Jan. 6, 1976

[54] EFFICIENCY ARC DISCHARGE LAMP

[75] Inventors: Timothy Fohl, Carlisle; James C. Morris, Wakefield, both of Mass.

[73] Assignee: GTE Sylvania Incorporated, Danvers, Mass.

[22] Filed: July 15, 1974

[21] Appl. No.: 488,633

[52] U.S. Cl. ..... 313/113; 313/116

[51] Int. Cl.[2] ..... H01J 61/40; H01J 5/16

[58] Field of Search ..... 313/113–116, 313/25, 223, 117

[56] References Cited

UNITED STATES PATENTS

| | | | |
|---|---|---|---|
| 2,963,611 | 12/1960 | Meister et al. | 313/116 |
| 3,162,785 | 12/1964 | Scoledge et al. | 313/113 |
| 3,221,198 | 11/1965 | Der Wal et al. | 313/113 X |
| 3,400,288 | 9/1968 | Groth | 313/113 X |
| 3,485,343 | 12/1969 | Jorgensen | 313/25 X |

*Primary Examiner*—Alfred L. Brody

*Attorney, Agent, or Firm*—James Theodosopoulos

[57] ABSTRACT

The arc tube of an electric discharge lamp is surrounded by a reflective filter. The filter selectively reflects arc discharge radiation outside the visible range to which the arc tube wall is transparent and to which the arc plasma is optically thick, so that the reflected radiation is preferentially absorbed by the plasma and not by the arc tube wall.

5 Claims, 1 Drawing Figure

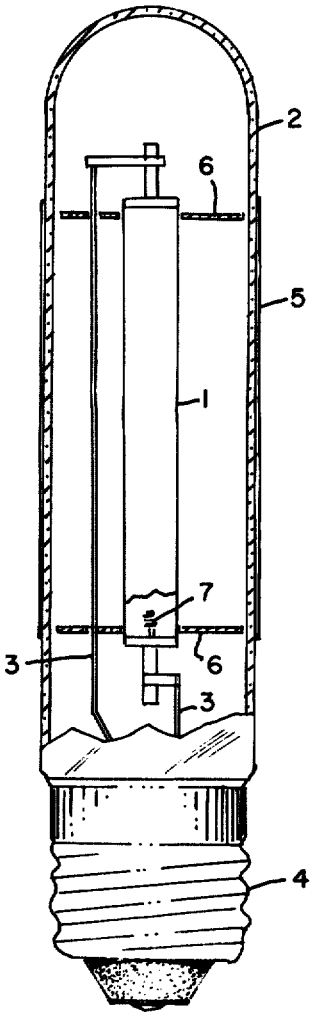
2
6
5
1
7
3
6
3
4

EFFICIENCY ARC DISCHARGE LAMP

BACKGROUND OF THE INVENTION

1. Field of the Invention

This invention relates to electric arc discharge lamps containing light emitting metals the desired radiation of which is in the visible region of the spectrum.

2. Description of the Prior Art

It is known, in the field of electric discharge lamps, to employ filters or reflectors which are transparent to desired visible radiation and reflective of undesired radiation, e.g., infrared radiation. See, for example, U.S. Pat. Nos. 3,221,198, 3,400,288 and 3,662,203 which disclose the use of thin metal layers, tin oxide coatings and titanium oxide coatings for such purposes.

Such reflectors are generally broad band; they improve lamp efficiency by returning the reflected radiation to the arc tube wall, thereby reducing the amount of power required to maintain a predetermined minimum wall temperature. However, such reflectors do not efficiently reflect radiation directly back to the arc plasma itself, that is, radiation to which the arc plasma is optically thick.

It is an object of this invention to provide a high intensity discharge lamp having a reflective filter which improves lamp efficiency more than prior art broad band reflectors do, by reflecting particular undesired radiation directly to the arc plasma.

SUMMARY OF THE INVENTION

Any radiating material, solid, liquid or gas, radiates energy at a rate $P$ given by $$P = e_{\lambda T} \left(\frac{C_1}{\lambda^5}\right) \left(e^{-C_2/\lambda T^{-1}}\right)^{-1}$$

where $T$ is the temperature in °K, $e_{\lambda T}$ is the spectral emissivity of the material and is a function of λ(wavelength) and $T$, and $C_1$ and $C_2$ are constants. The emissivity can vary between 0 and 1.0.

The amount of radiation in any wavelength band is determined by the temperature of the radiator and the emissivity of the radiator in that wavelength region.

A lamp designer seeks to concentrate as much of the radiation as possible from a lamp in a particular wavelength band. For general illumination this band is determined by the eye sensitivity and is about 400 to 700 nanometers. For other applications, such as photo polymerization, the band is determined by the action spectrum of the irradiated material.

Arc discharges differ from solid radiation sources such as tungsten filaments in that their emissivity varies greatly with wavelength. Materials for the discharge gas are chosen to give high emissivity (strong spectral lines) in the wavelength band of interest.

Ideally the emissivity should be high in the wavelength band of interest and zero everywhere else. This condition would minimize the energy lost as useless radiation. Unfortunately many materials commonly used in arc discharge lamps have strong spectral lines, and thus high emissivity, outside the wavelength band of interest.

This invention is intended to reduce the effective emissivity of the lamp in regions outside the wavelength band of interest by reflecting the useless radiation back into the arc. The reflector is selective in that it only returns energy of those wavelengths at which the arc emissivity is high but are in the useless wavelength region. The reflector passes energy in the desired wavelength band from the lamp.

The return of energy to the arc is effective only for wavelengths at which the arc is a strong absorber. The arc is a stron absorber of energy, i.e., is optically thick, at the wavelengths at which it has a high emissivity. The selective reflector must reflect those wavelengths with high emissivity back into the arc in order to effectively return energy to the arc.

In general the only reflectors which are sufficiently selective to pass the desired wavelengths and reflect those with high emissivity outside the desired wavelength band are dichroic reflectors. As a rule dichroic reflectors are simpler and cheaper if they are only required to reflect strongly over relatively narrow bands of wavelength. One advantage of this invention is that the dichroic reflector need only reflect strongly at those useless wavelengths which are strongly emitted by the arc.

BRIEF DESCRIPTION OF THE DRAWING

The single FIGURE in the drawing is an elevational view, partly in section, of a high pressure sodium (HPS) arc discharge lamp in accordance with this invention.

DESCRIPTION OF THE PREFERRED EMBODIMENT

As shown in the drawing, one embodiment of an arc discharge lamp in accordance with this invention comprises a cylindrical alumina arc tube 1 disposed within a cylindrical transparent glass envelope 2. Arc tube 1 contains the usual HPS fill of sodium, mercury and an inert starting gas. Arc tube 1 is supported within envelope 2 by the usual lead-in wire assembly 3, which provides the electric current path from the usual screw-type base 4 to the electrodes 7 at the ends of arc tube 1.

Disposed on the outer surface of envelope 2 is a dichroic reflector 5. Reflector 5 is formulated to efficiently transmit visible radiation and to efficiently reflect nonvisible radiation to which the arc discharge plasma is optically thick. In a typical HPS lamp, only 43% of the radiation is in the visible range and there is substantial radiation at four wavelength regions outside the visible. These are at 810, 1140, 1840 and 2200 nanometers; the respective absorption coefficients of the arc plasma at these wavelengths are 0.95, 0.64, 0.50 and 0.84. Reflector 5 was formulated to efficiently reflect radiation at these wavelength regions. Thus reflector 5 was simpler and less expensive to apply than, say, a broad band dichroic reflector, such as disclosed in the prior art for incandescent lamps, which reflect infrared radiation over a wide range. Such prior art broad band reflectors are, also, inefficient reflectors of the near infrared radiation such as at 810 and 1140 nanometers.

Reflector 5 consisted of thirteen quarter-wave alternate layers of vacuun deposited $TiO_2$ and $SiO_2$, sandwiched between eighth-wave layers of $SiO_2$. The reflection curve of reflector 5 was fairly narrow-band, having a reflection of less than 5 percent over the visible range (400 to 700 nanometers), about 95 percent over the range of 800 to 1200 nanometers, and a peak reflection at 1800 to 2200 nanometers of about 25 percent. The calculated improvement in lamp efficiency was 26.6 percent.

Although this reflector is more efficient in reflecting the 810 and 1140 radiation to the plasma than the 1840 and 2200 radiation, the arc tube emits more of the former radiation than the latter. The respective relative emitted peak power outputs for 810, 1140, 1840 and 2200 radiation are 0.43, 0.08, 0.06 and 0.04.

If desired, opaque and reflectors 6 may be disposed within envelope 2 at the ends of arc tube 1 in order to prevent end radiation, thereby improving lamp efficiency even further.

We claim:

1. A high intensity arc discharge lamp comprising an arc tube containing a light emitting metal and having electrodes at its ends, the arc tube emission including both desired and undesired radiation, and a selective reflector surrounding said arc tube, said reflector efficiently transmitting desired radiation and efficiently reflecting portions of the undesired radiation to which the arc tube wall is transparent and to which the discharge plasma is optically thick, the reflection being sufficient to substantially improve lamp efficiency, said efficienctly reflected portions of undesired radiation including radiation at 810 and 1140 nanometers.

2. The lamp of claim 1 wherein said selective reflector is a dichroic coating.

3. The lamp of claim 2 wherein said coating comprises alternate layers of $TiO_2$ and $SiO_2$.

4. The lamp of claim 3 comprising, in addition, a light-transmitting jacket surrounding said arc tube, said coating being deposited on said jacket.

5. The lamp of claim 4 wherein said arc tube is made of alumina.

* * * * *